US008875872B2

(12) United States Patent
Bulls, Jr.

(10) Patent No.: US 8,875,872 B2
(45) Date of Patent: Nov. 4, 2014

(54) RETAIL DISPLAY PACKAGE WITH FOLDABLE STAND

(75) Inventor: Carl A. Bulls, Jr., Brooklyn Park, MN (US)

(73) Assignee: Target Brands, Inc., Minneapolis, MN (US)

( * ) Notice: Subject to any disclaimer, the term of this patent is extended or adjusted under 35 U.S.C. 154(b) by 318 days.

(21) Appl. No.: 13/413,132

(22) Filed: Mar. 6, 2012

(65) Prior Publication Data

US 2013/0233763 A1 Sep. 12, 2013

(51) Int. Cl.
*B65D 25/24* (2006.01)
*B65D 5/52* (2006.01)

(52) U.S. Cl.
USPC ..... 206/45.24; 206/806

(58) Field of Classification Search
USPC ..... 206/45.24, 45.25, 45.26, 45.27, 45.21, 206/806, 775, 779, 780; 248/174, 459, 152, 248/150, 146, 318
See application file for complete search history.

(56) References Cited

U.S. PATENT DOCUMENTS

| | | | | | |
|---|---|---|---|---|---|
| 631,520 | A | * | 8/1899 | Dalsheimer | 248/459 |
| 821,132 | A | * | 5/1906 | Springman | 248/459 |
| 1,167,031 | A | * | 1/1916 | Ullrich | 248/459 |
| 1,515,741 | A | | 11/1924 | Lyons | |
| 1,668,171 | A | * | 5/1928 | Pratt | 312/42 |
| 2,000,870 | A | * | 5/1935 | Ziemmerman | 206/740 |
| 2,134,124 | A | | 11/1938 | Englar | |
| 2,595,202 | A | | 4/1952 | Pardee | |
| 2,611,572 | A | * | 9/1952 | La Rocca | 248/174 |
| 2,730,324 | A | * | 1/1956 | Taylor, Jr. | 248/459 |
| 2,765,906 | A | | 10/1956 | Rossum | |
| 2,845,733 | A | * | 8/1958 | Fox | 40/750 |
| 3,081,868 | A | | 3/1963 | Zimmers | |
| 3,219,181 | A | | 11/1965 | Dahm | |
| 3,266,687 | A | | 8/1966 | Isoldi | |
| 3,407,928 | A | | 10/1968 | Watts, Jr. | |
| 3,557,945 | A | | 1/1971 | Gourio | |
| 3,685,649 | A | * | 8/1972 | Diehl | 206/45.24 |
| 3,688,897 | A | * | 9/1972 | Judd et al. | 206/45.26 |
| 3,767,043 | A | * | 10/1973 | Margolis et al. | 206/315.1 |
| 3,847,282 | A | | 11/1974 | Collura et al. | |
| 3,990,578 | A | * | 11/1976 | Roeser | 206/461 |
| 4,130,197 | A | | 12/1978 | Fox | |
| 4,315,569 | A | * | 2/1982 | Jaeschke | 229/122 |

(Continued)

OTHER PUBLICATIONS

Office Action from Canadian Patent Application No. 2,794,001, mailed Feb. 13, 2013 (3 pages).

*Primary Examiner* — Jacob K Ackun
(74) *Attorney, Agent, or Firm* — Griffiths & Seaton PLLC; JoAnn M. Seaton

(57) ABSTRACT

A display package includes a wrap portion, and first and second stand portions. The wrap portion defines a front panel, a rear panel opposite the front panel, and a bottom panel extending between the front and rear panels. The front, rear, and bottom panels form a cavity therebetween for receiving an article for display. The first and second stand portions each extend from the rear panel opposite one another. At least a portion of the first stand portion and a portion of the second stand portion are placed directly adjacent and are coupled to one another to collectively form a two-ply fin capable of being folded flat over the rear panel or folded out to extend away from the rear panel to act as a stand for supporting the display package with a substantially upright position on a support surface.

23 Claims, 10 Drawing Sheets

(56) References Cited

U.S. PATENT DOCUMENTS

| | | | | | |
|---|---|---|---|---|---|
| 4,531,637 | A | | 7/1985 | Cusmano | |
| 4,579,232 | A | | 4/1986 | Fedak | |
| 4,819,354 | A | * | 4/1989 | Papov | 40/789 |
| 4,930,627 | A | | 6/1990 | Borst et al. | |
| 5,269,408 | A | * | 12/1993 | Otis et al. | 206/288 |
| 5,305,875 | A | * | 4/1994 | Meyer | 206/45.25 |
| 5,351,882 | A | | 10/1994 | Krautsack | |
| 5,529,181 | A | | 6/1996 | Brier | |
| 6,196,387 | B1 | | 3/2001 | Hsi-Chang | |
| 6,685,024 | B1 | * | 2/2004 | Matthews | 206/521 |
| 6,929,117 | B1 | | 8/2005 | Cohen | |
| 7,413,075 | B2 | | 8/2008 | David et al. | |
| 7,627,967 | B1 | * | 12/2009 | Torvik | 40/124.16 |
| 8,322,664 | B2 | * | 12/2012 | Booth | 248/152 |
| 2006/0060481 | A1 | | 3/2006 | Hartman et al. | |
| 2008/0283435 | A1 | | 11/2008 | Morgan | |
| 2008/0283695 | A1 | | 11/2008 | Morgan | |

* cited by examiner

RETAIL DISPLAY PACKAGE WITH FOLDABLE STAND

BACKGROUND OF THE INVENTION

Retailers are continually evolving product displays in hopes of discovering more effective and visually attractive means for displaying products to potential consumers. The packaging for products may be designed to facilitate product display. For example, given the limited shelf space available in retail stores, it is often desirable to provide product packaging configured to facilitate hanging of products from rods, pegs, or other display fixture support members.

SUMMARY OF THE INVENTION

One aspect of the present invention relates to a display package for retail displays. In one embodiment, a display package includes a wrap portion, and first and second stand portions. The wrap portion defines a front panel, a rear panel opposite the front panel, and a bottom panel extending between the front panel and the rear panel. The front panel, the rear panel, and the bottom panel form a cavity therebetween for receiving an article to be displayed. The first stand portion and the second stand portion each extend from the rear panel opposite one another. At least a portion of the first stand portion and a portion of the second stand portion are placed directly adjacent and are coupled to one another to collectively form a two-ply fin capable of being folded flat over the rear panel or folded out to extend rearwardly away from the rear panel to act as a stand for supporting the display package with a substantially upright position on a support surface. Other packages, assemblies, and methods are also described.

BRIEF DESCRIPTION OF THE DRAWINGS

Embodiments of the invention will be described with respect to the figures, in which like reference numerals denote like elements, and in which.

DETAILED DESCRIPTION

Figure 1:
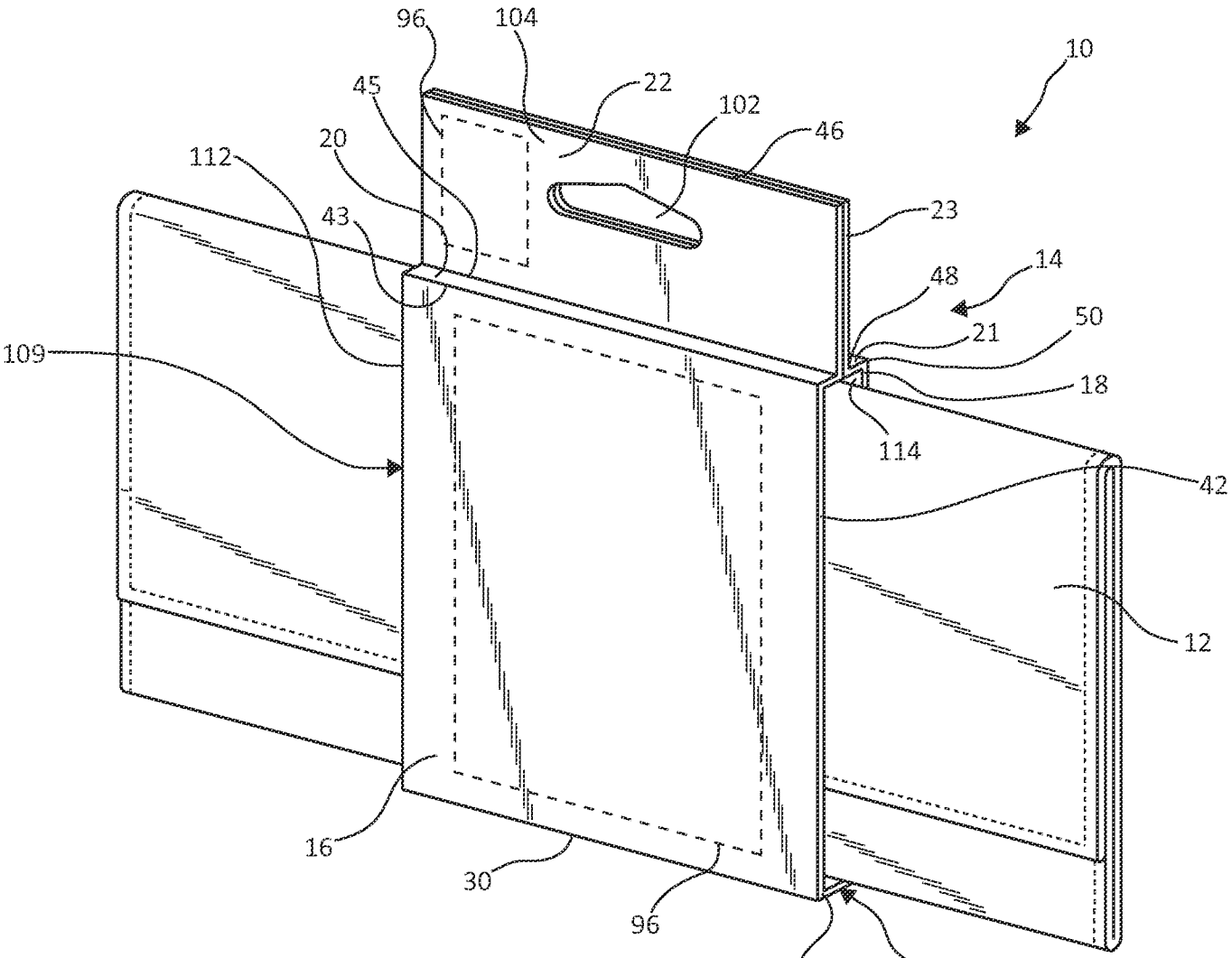
FIG. 1 is a front, perspective view illustration of a packaged product with a stand folded out from a display package, according to one embodiment of the present invention.
Figure 2:
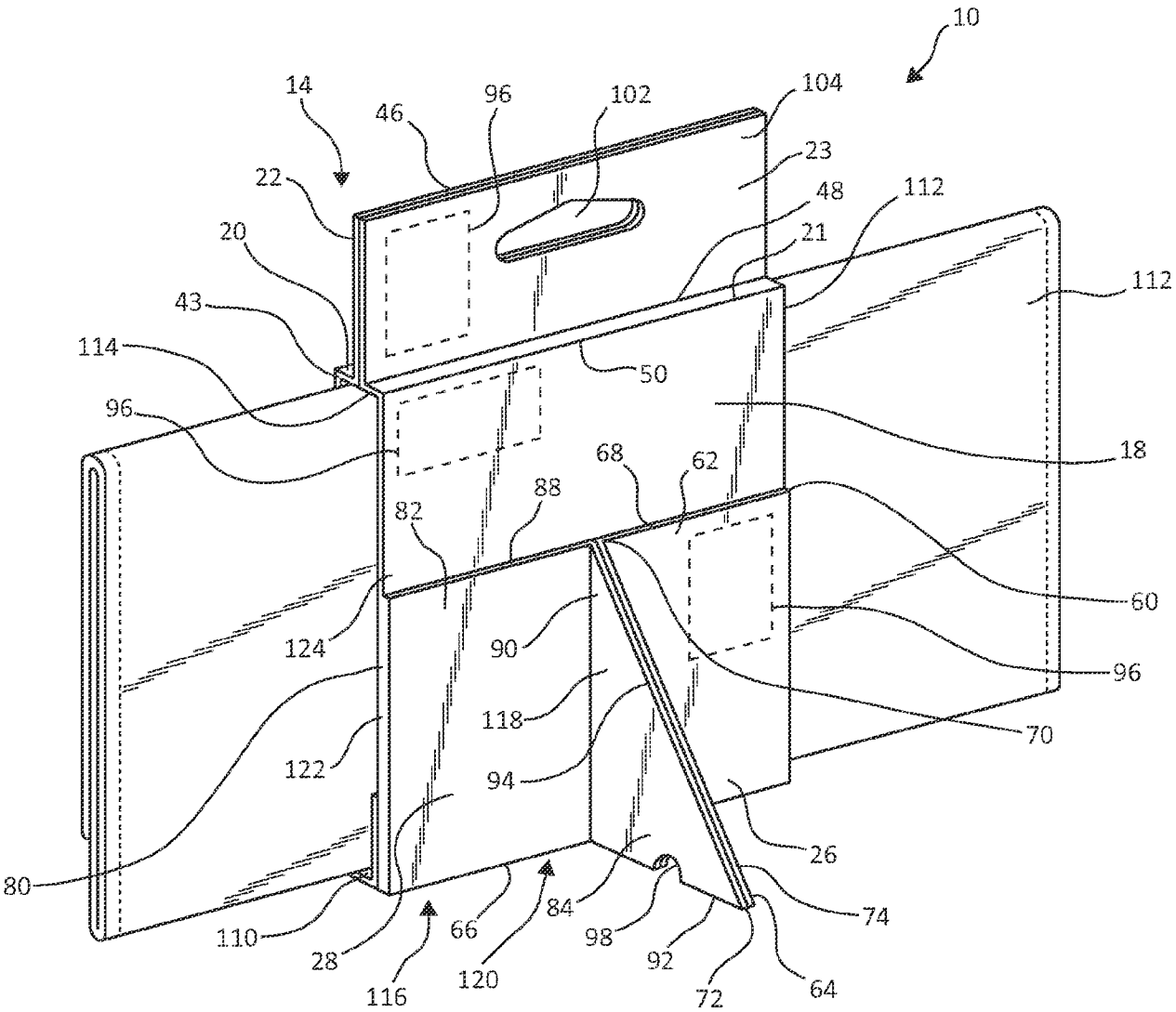
FIG. 2 is a back, perspective view illustration of the packaged product of FIG. 1, according to one embodiment of the present invention.
Figure 3:
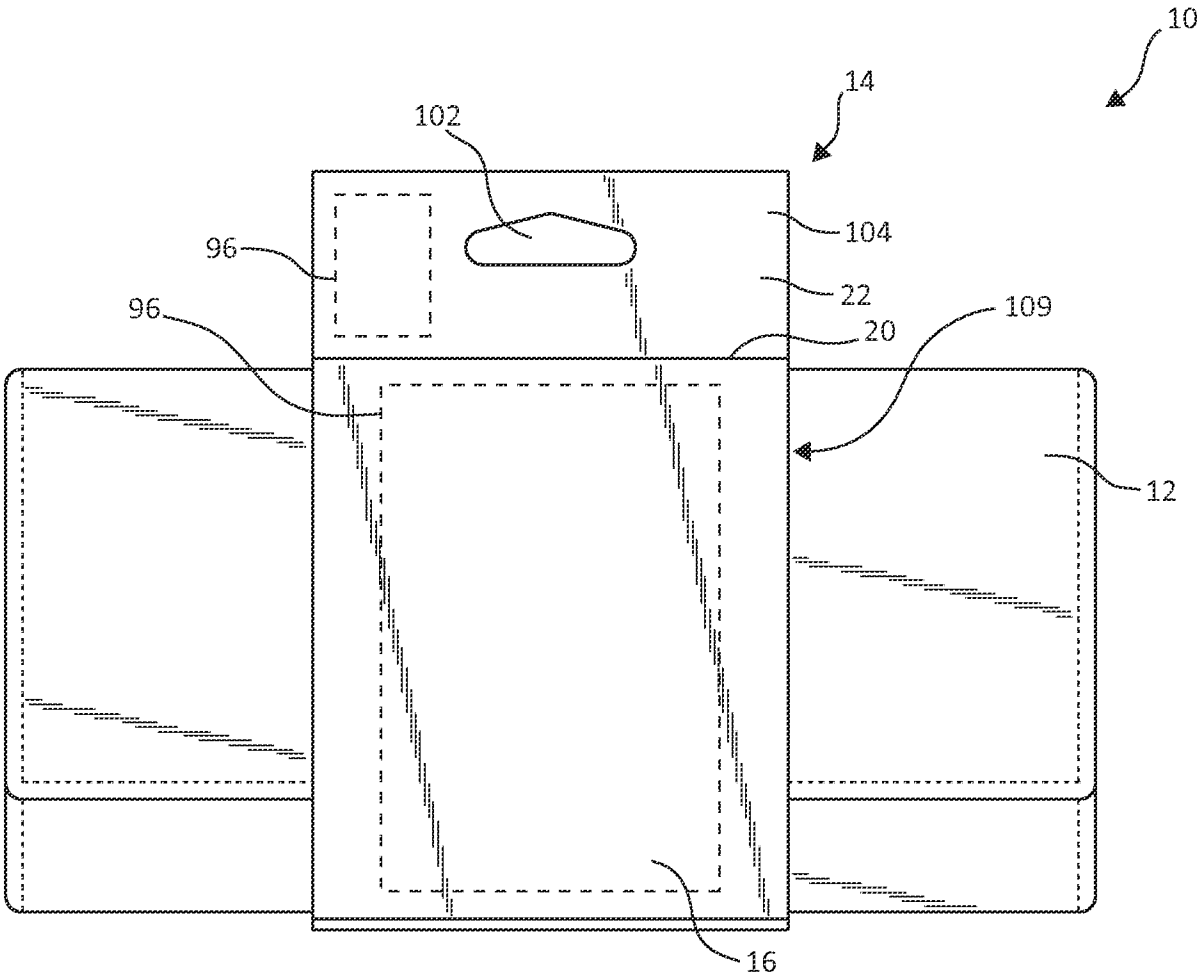
FIG. 3 is a front view illustration of the packaged product of FIG. 1, according to one embodiment of the present invention.
Figure 4:
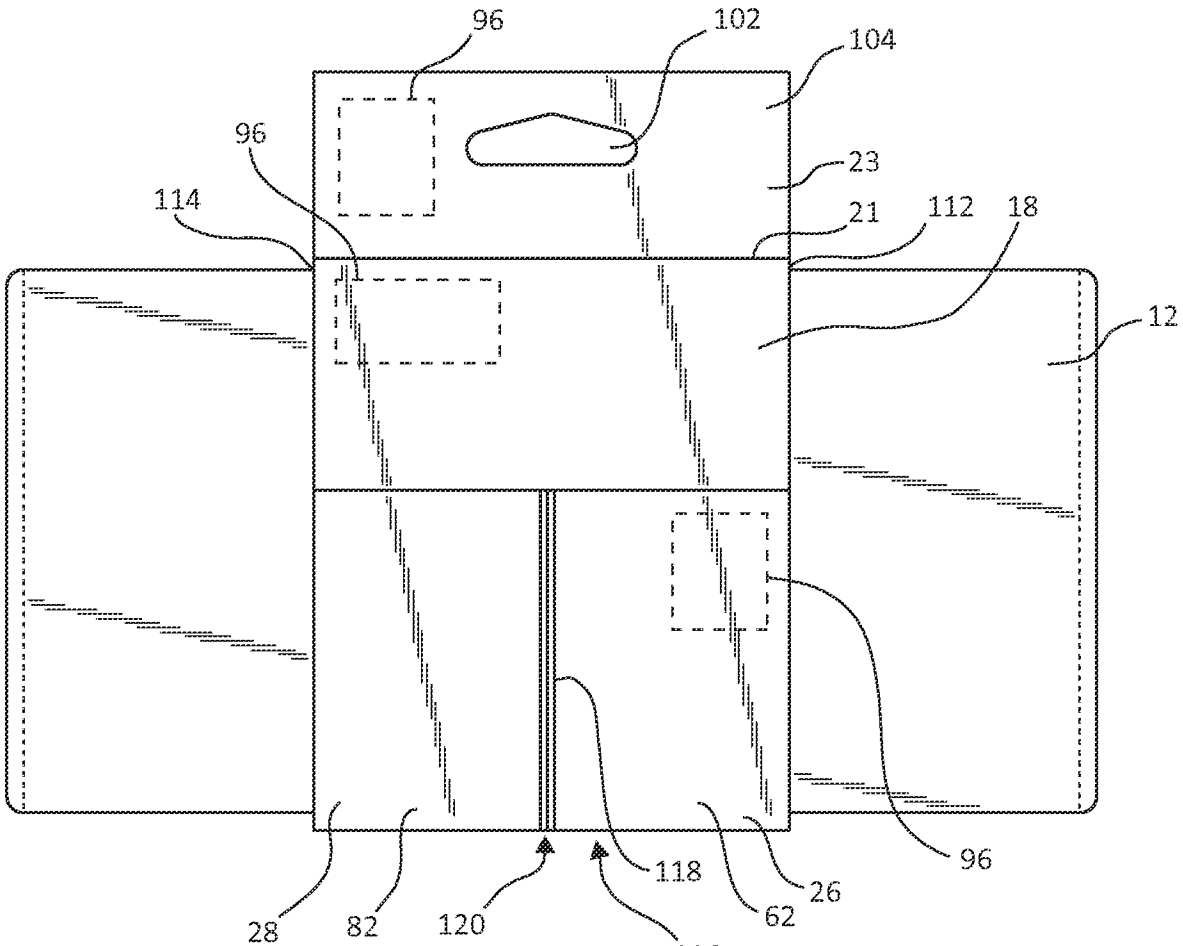
FIG. 4 is a back view illustration of the packaged product of FIG. 1, according to one embodiment of the present invention.
Figure 5:
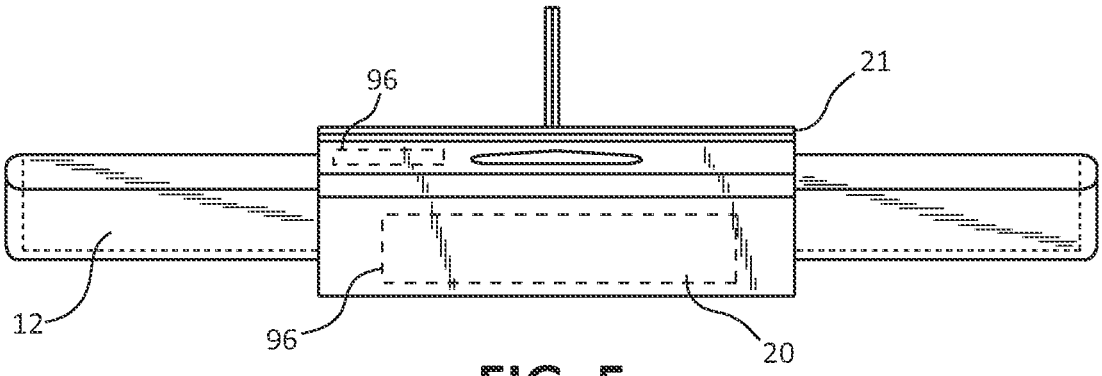
FIG. 5 is a top view illustration of the packaged product of FIG. 1, according to one embodiment of the present invention.
Figure 6:
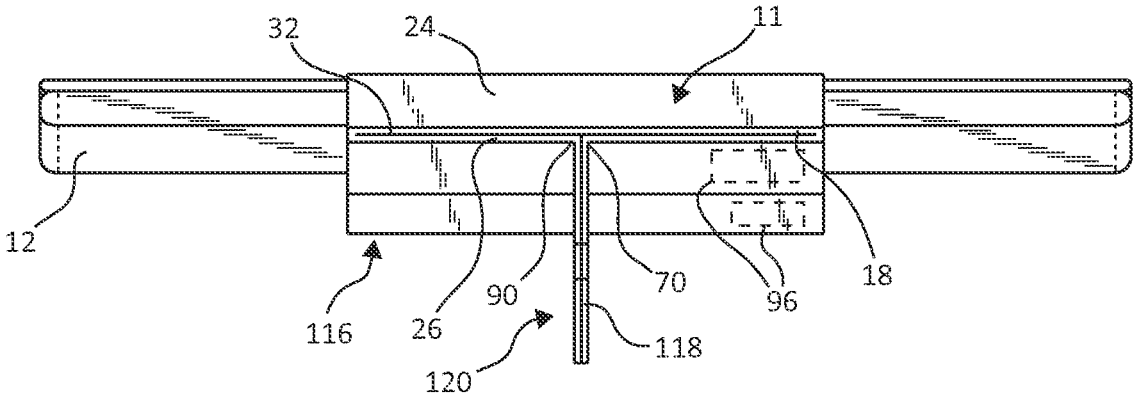
FIG. 6 is a bottom view illustration of the packaged product of FIG. 1, according to one embodiment of the present invention.
Figure 7:
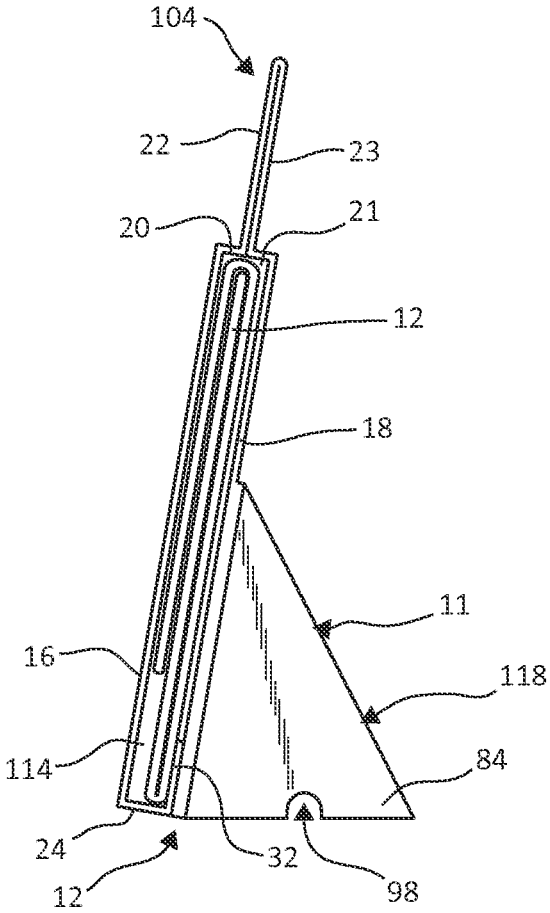
FIG. 7 is a right side view illustration of the packaged product of FIG. 1, according to an embodiment of the present invention. The left side view is a mirror image of the right side view.

The following detailed description of the invention provides examples and is not intended to limit the invention or the application and uses of the invention. Furthermore, there is no intention to be bound by any theory presented in the preceding background of the invention or the following detailed description of the invention.

Embodiments of the present invention are configured to at least partially wrap an article for retail sale and to facilitate both hanging the article from a retail display fixture and standing the article on a retail display fixture. For example, the article is inserted into packaging to form a packaged product. The packaging includes a wrap portion extending around the article, a tab extending upwardly from the wrap portion to facilitate hanging the packaged product, and a stand extending from a rear panel of the wrap portion to facilitate standing the packaged product. The stand includes a fin that can be folded flat against the wrap portion to allow the partially wrapped article to hang from a support rod via the tab and folded to extend away from the wrap portion to stand the product on a support surface. As such, the packaged product occupies a minimal amount of space on the retail display fixture and provides increased flexibility for product placement with a retail store or other storage area.

With reference now to FIGS. 1-8, in one embodiment, a packaged product 10 includes an article 12 and a display package 14. Article 12 is a product or merchandise that is to be hung on a retail product or other display (e.g., retail product display 300 in FIG. 11) or maintained in a substantially upright position on a horizontal surface for retail or other display. For example, article 12 is a purse, wallet, laptop bag, accessory, box, game, or another retail item that a retailer may desire to display in various positions. In other examples, article 12 is a container that includes one or more items a consumer may purchase (e.g., a clothing item, shoes, jewelry, electronics, toys, kitchen items, home goods, healthcare products, or other merchandise). Although article 12 is shown as being a generally rectangular item, article 12 having other shapes, e.g., oval, square, etc., is also contemplated.

Display package 14 surrounds article 12 to enclose a portion of article 12 therein and provides surface area for display of promotional and/or information indicia, e.g., indicia 96 as will be further described below, relating to article 12. Display package 14 may be folded from a single planar blank 15 of a suitable material, such as plastic, cardboard, paperboard, and the like. In an embodiment, display package 14 is formed from biodegradable material that can be recycled and/or material that reduces environmental impact of package manufacturing.

Figure 9:
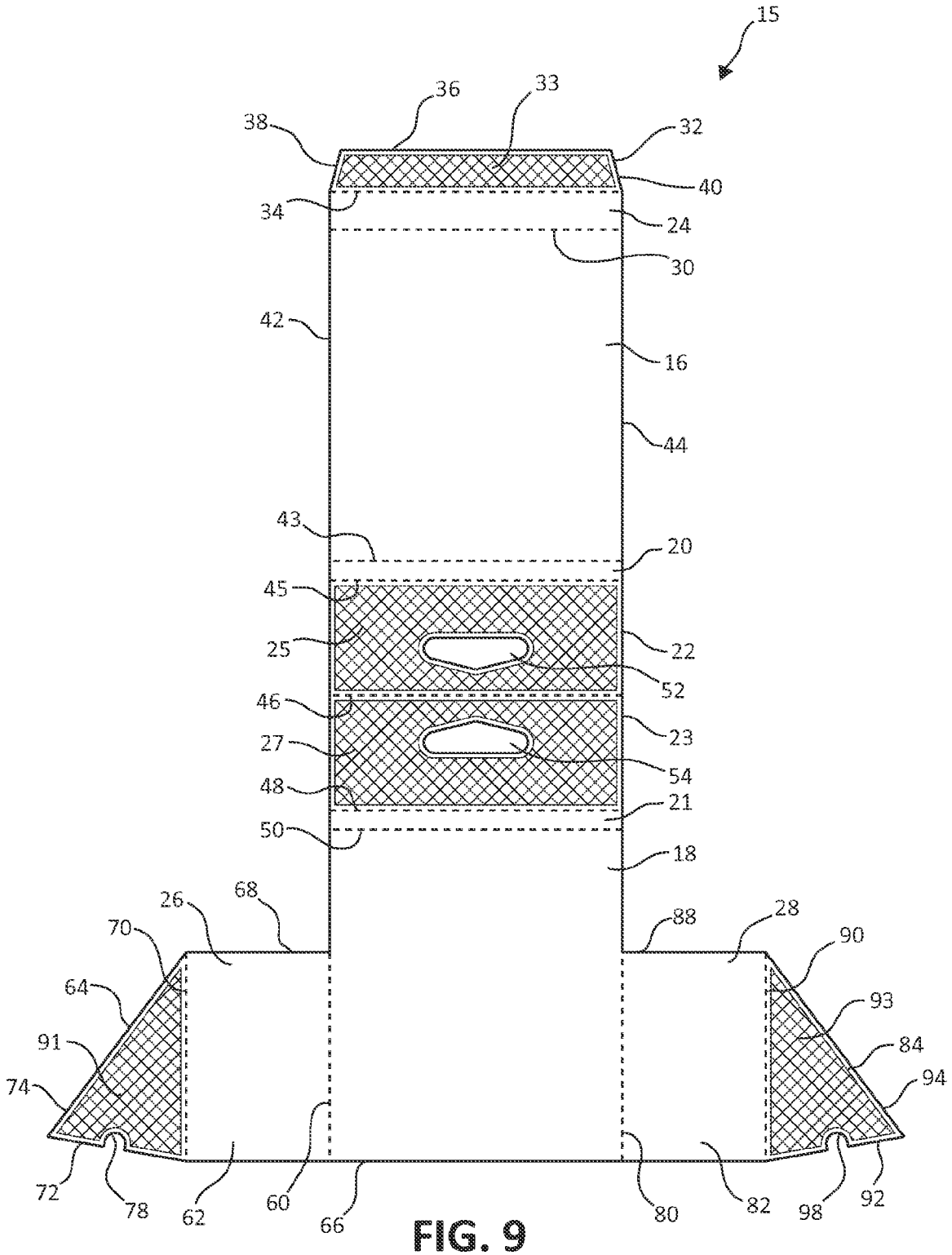
FIG. 9 is a front view of an unfolded blank for forming a display package of a packaged product, according to an embodiment of the present invention.

With additional reference now to FIG. 9, display package 14 defines a plurality of panels or walls separated from each other by one or more fold lines. In particular, display package 14 defines a first major or front panel 16, a second major or rear panel 18, a first top panel 20, a second top panel 21, a first tab panel 22, a second tab panel 23, a base or bottom panel 24, a first stand portion 26, and a second stand portion 28. Front panel 16 is extended longitudinally from rear panel 18, and front and rear panels 16 and 18 are substantially similarly shaped and dimensioned, in an embodiment. For example, each of front panel 16 and rear panel 18 is a rectangle having a height greater than a width. Alternatively, front panel 16 has a height and/or width that is greater than the height and/or width of rear panel 18, or vice versa.

As illustrated, bottom panel 24 extends longitudinally from front panel 16 opposite rear panel 18 and borders front panel 16 along a laterally extending fold line 30. Bottom panel 24 includes a flap 32 extending therefrom for attachment to rear panel 18 to form display package 14. Flap 32 borders bottom panel 24 along a laterally extending fold line 34 opposite front panel 18 and defines a laterally extending free edge 36 opposite fold line 34. In an embodiment, flap 32 includes side edges 38 and 40 that angle toward each other so that when display package 14 is formed, flap 32 is substantially hidden from view. Alternatively, side edges 38 and 40 are not angled and form portions of longitudinally extending major side edges 42 and 44, which extend opposite each other along front panel 16 and bottom panel 24. Although flap 32 is depicted as being substantially equal in height to bottom panel 24, flap 32 may alternatively be longer or shorter. Additionally, although flap 32 is illustrated in FIG. 9 as being substantially trapezoidal, flap 32 can be another shape suitable for providing a surface for receiving an adhesive and attached to rear panel 18. Although primarily described as extending from front panel 16 opposite rear panel 18, in other examples, bottom panel 24 and/or flap 32 extend from an edge of rear panel 18 opposite front panel 16 as will be apparent to those of skill in the art upon reading the instant application. In examples in which article 12 is quite narrow along a lower or bottom edge thereof, bottom panel 24 may be greatly reduced in size or eliminated.

A portion of flap 32 may be designated to receive adhesive 33, generally indicated with hatching in FIG. 9. According to an embodiment, adhesive 33 extends across substantially all of a first or front surface of flap 32. Alternatively, adhesive 33 is located on a second or back surface on an opposite side of flap 32. In other embodiments, adhesive 33 is applied to a smaller area, for example, half of flap 32. Although adhesive 33 is shown as being continuously applied across the surface of flap 32, other options for application of adhesive 33 include successive strips, multiple circles, and the like.

Top panels 20 and 21 and tab panels 22 and 23 separate front panel 16 from rear panel 18. More specifically, first top panel 20 borders front panel 16 along a laterally extending fold line 43. Additionally, first tab panel 22 borders first top panel 20 along a laterally extending fold line 45. First tab panel 22 borders second tab panel 23 along a laterally extending fold line 46. Second top panel 21 borders second tab panel 23 along a laterally extending fold line 48, and rear panel 18 borders second top panel 21 along a laterally extending fold line 50. In one example, fold lines 34, 43, 45, 46, 48, and/or 50 extend substantially parallel to one another.

As illustrated, tab panels 22 and 23 are larger than first and second top panels 20 and 21. In particular, tab panels 22 and 23 have greater heights than top panels 20 and 21. In another embodiment, tab panels 22 and 23 have shorter heights than top panels 20 and/or 21. Tab panels 22 and 23 may be substantially similarly shaped and dimensioned. Alternatively, tab panels 22 or 23 are otherwise dimensioned such that when tab panels 22 and 23 are folded along fold line 46, at least a portion of one panel 22 or 23 contacts a portion of the other panel 22 or 23 to be attached thereto. Tab panels 22 and 23 include areas for receiving adhesive 25 and 27 or other coupling agent as generally illustrated with hatching. Adhesives 25 and 27 each extend across substantially all of corresponding tab panels 22 and 23. In other instances, adhesives 25 and 27 collectively form a single area spanning across both tab panels 22 and 23, or adhesive 25 and/or 27 is applied to multiple areas on the surface of tab panels 22 and/or 23.

Apertures 52 and 54 are formed through each tab panel 22 and 23 at locations such that when tab panels 22 and 23 are folded along fold line 46, apertures 52 and 54 are substantially aligned with each other. In accordance with an embodiment, apertures 52 and 54 are similarly shaped and configured to allow display package 14 to be hung from a support rod (e.g., support rod 312 in FIG. 11). For example, apertures 52 and 54 are substantially triangularly shaped and are mirror images of each other, as illustrated in the figures. In other examples, apertures 52 and 54 are rectangular, circular, ovular mirror images of each other or another shape, or form a hook or shape other than an enclosed hole that is still configured to receive a support rod.

First and second top panels 20 and 21 are substantially equal in height and width as illustrated. Alternatively, one of top panels 20 or 21 is larger than the other top panel 20 or 21. In particular, in embodiments in which tab panels 22 and 23 are closer to rear panel 18 than to front panel 16 when display package 14 is formed to allow article 12 to be more prominently displayed in a more forward position, first top panel 20 is greater in height than second top panel 21. Alternatively, if tab panels 22 and 23 are closer to front panel 16 than to rear panel 18 when display package 14 is formed, first top panel 20 is shorter in height than second top panel 21. In examples in which article 12 is quite narrow along a top edge thereof, one or both of top panels 20 and 21 may be greatly reduced in size or eliminated.

Front panel 16, top panels 20 and 21, tab panels 22 and 23, and a portion of rear panel 18 are of substantially similar or substantially identical widths. In this regard, as alluded to briefly above, panels 16, 18, 20, 21, 22, 23, and 24 collectively define longitudinally extending free side edges 42 and 44 on either side. Although side edges 42 and 44 are shown as being substantially parallel to each other, other embodiments include side edges 42 and 44 that angle toward each other or away from each other and/or are wavy or otherwise nonlinear in orientation.

First stand portion 26 laterally extends outwardly from rear panel 18 and borders rear panel 18 along a longitudinally extending fold line 60 as shown in the figures. In an embodiment, a portion of side edge 42 defined by rear panel 18 extends above fold line 60 and first stand portion 26 is longitudinally shorter than rear panel 18. First stand portion 26 includes a first extension wall or panel 62 and a first support or fin wall or panel 64. First extension panel 62 has a width that is substantially equal to about half of the total width of rear panel 18. In another instance, first extension panel 62 is wider or narrower than half the total width of rear panel 18. First extension panel 62 partially defines a laterally extending free edge 66 along with rear panel 18. As illustrated, free edge 66 extends in a substantially linear manner substantially parallel to laterally extending fold line 50 and, in one example, is collectively defined by first stand portion 26, second stand portion 28, and rear panel 18. Alternatively, free edge 66 is made up of angled segments, where one segment defined by first extension panel 62 is angled relative to another segment defined by rear panel 18.

In one example, first extension panel 62 is shorter than rear panel 18. In such case, first extension panel 62 terminates opposite free edge 66 at a top free edge 68 positioned lower than or otherwise offset from fold line 50. In another example, top free edge 68 extends substantially co-linearly relative to fold line 50.

First fin panel 64 extends laterally from first extension panel 62 and borders first extension panel 62 along longitudinally extending fold line 70, for example, along a substantial entirety of fold line 70. According to an embodiment, first fin panel 64 is substantially triangular and defines a bottom or base edge 72 and lateral side edge 74. Base edge 72 extends from free edge 66, for example, at an angle relative to free edge 66. The angle at which base edge 72 is formed relative to free edge 66 depends on whether display package 14, when assembled, is to be positioned upright relative to a horizontal display surface (e.g., horizontal display surface 312 in FIG. 11) or angled relative to the surface. For instance, a greater angle between base edge 72 and free edge 66 allows display package 14 to stand in a more non-perpendicular manner on a horizontal display surface. In an embodiment in which base edge 72 extends substantially linearly from free edge 66 and is substantially perpendicular relative to fold line 60, display package 14 is positioned substantially perpendicularly or vertically relative to the horizontal display surface. In an alternative arrangement, in which base edge 72 extends at an angle relative to free edge 66 and is substantially perpendicular relative to fold line 60, display package 14 is positioned non-perpendicularly relative to the horizontal display surface. Base edge 72 itself may be substantially linear. In one example, a notch 78 is formed halfway along base edge 72. Notch 78 is included to improve stability of display package 14 when display package is positioned upright.

Lateral side edge 74 extends from base edge 72 inwardly toward top free edge 68. For example, lateral side edge 74 forms an angle of between about 30 degrees and about 45 degrees with top free edge 68. In other embodiments, the angle between lateral side edge 74 and top free edge 68 is greater or less than the aforementioned range. In instances where the first fin panel 64 is square or rectangular, lateral side edge 74 may be substantially perpendicular relative to top free edge 68.

In one example, second stand portion 28 extends from an opposite side of rear panel 18 as compared to first side panel 26 and is substantially symmetrical with first side panel 26. More specifically, second stand portion 28 laterally extends outwardly from rear panel 18 and borders rear panel 18 along a longitudinally extending fold line 80 opposite fold line 60 as shown in the illustrations. In an embodiment, a portion of side edge 44 defined by rear panel 18 extends above fold line 80 and second stand portion 28 is longitudinally shorter than rear panel 18. Second stand portion 26 includes a second extension panel 82 and a second support panel or fin panel 84. Second extension panel 82 has a width that is substantially equal to about half of the total width of rear panel 18. Second extension panel 82 is illustrated as being wider than half the total width of rear panel 18, but may be narrower in other instances. Second extension panel 82 partially defines a laterally extending free edge 66 along with rear panel 18. According to an embodiment, free edge 66 along second extension panel 82 extends in a substantially linear manner substantially parallel to laterally extending fold line 50. In another option, free edge 66 is made up of angled segments, where one segment, defined by second extension panel 82, is angled relative to another segment defined by rear panel 18.

In one example, second extension panel 82 is shorter than rear panel 18. In such case, second extension panel 82 terminates opposite free edge 66 at a top free edge 88 positioned lower than fold line 50. In another example, top free edge 88 extends substantially linearly relatively to fold line 50.

As illustrated in the figures, extension panel 82 is substantially a mirror image of first extension panel 62, but may be larger or smaller than first extension panel 62. For example, second extension panel 82 has a width that is greater than half the width of rear panel 18, and first extension panel 62 has a width that is less than half the width of rear panel 18, or vice versa.

Second fin panel 84 extends laterally from second extension panel 82 and borders second extension panel 82 along a longitudinally extending fold line 90, for example, along a substantial entirety of fold line 90. Second fin panel 84 defines a bottom or base edge 92 and lateral side edge 94. Base edge 92 partially defines free edge 66 and extends at an angle relative to free edge 66. The angle at which base edge 92 is formed relative to free edge 66 is substantially similar to the angle between base edge 72 and free edge 66. In an embodiment, a notch 98 is along base edge 92.

Lateral side edge 94 extends from base edge 92 and terminates at top free edge 88. For example, lateral side edge 94 forms an angle of between about 30 degrees and about 45 degrees with top free edge 88, although other angles are also contemplated. In still other embodiments in which second fin panel 84 is square or rectangular, lateral side edge 94 is substantially perpendicular relative to top free edge 88.

According to an embodiment, second fin panel 84 is configured to be substantially a mirror image of first fin panel 64 so that the outer peripheral edges, e.g., lateral side edges 74 and 94, of each of the two fin panels 64 and 84 aligned with each other when display package 14 is formed. Thus, where first fin panel 64 is triangular, second fin panel 84 is also triangular. In another example, second fin panel 82 is shaped or otherwise configured differently than first fin panel 62. For instance, first fin panel 62 has a first shape, such as triangular, and second fin panel 82 has a second shape, such as rectangular. In such case, base edges 72 and 92 are still substantially similarly angled relative to free edge 66, while lateral side edge 74 may be disposed at a smaller angle relative to free edge 68 than lateral side edge 94 and free edge 88. No matter the particular shapes, first and second fin walls 62 and 82 are shaped such that at least a portion of each (e.g., portions covered with adhesive 91 and 93) can be attached to each other when display package 14 is formed, and base edges 72 and 92 can extend along and contact a horizontal display surface when display package is disposed in an upright position. Adhesives 91 and/or 93 may extend across substantially all of a surface of corresponding fin panel 62 or 82 or occupy smaller areas, for example, half of each of fin panel 62 or 82. Although adhesive 91 and 93 are illustrated as being continuous across back surface of fin panels 62 and 82, other placement alternatives for adhesive 91 and 93 include successive strips, multiple circles, and the like.

In an embodiment, indicia, generally indicated by dashed box 96 in FIGS. 1-8, is included on an exterior of display package 14. In one example, indicia 96 is included on any one or more of front panel 16, rear panel 18, top panels 20 or 21, tab panels 22 or 23, bottom panel 24, or stand portions 26 or 28. Indicia 96 generally includes promotional, identification, description, and/or other information regarding article 12 (e.g., dimensions of article 12, a picture of article 12, a brand associated with article 12, and/or other text).

To form display package 14, the single planar blank 15 is folded about fold lines 30, 34, 43, 45, 46 48, 50, 60, 70, 80, and 90. More particularly, blank 15 is folded about fold line 46 such that first and second tab panels 22 and 23 contact and are adhered to each other via adhesives 25 and 27 to form a tab 104. When first and second tab panels 22 and 24 are coupled to each other apertures 52 and 54 align with each other to form a single opening 102. Blank 15 is then folded upwardly relative to tab 104 about fold lines 45 and 48 and downwardly about fold line 43 and 50 to form first and second top panels 20 and 21. The resultant first and second top panels 20 and 21 extend in opposite directions from tab 104 to collectively form top wall 106, and front panel 12 and rear panel 18 extend downwardly from top wall 106. In one embodiment, front panel 12 and rear panel 18 extend substantially parallel to one another. Article 12 is then placed between front panel 12 and rear panel 18.

Once article 12 is in place and interposed between front panel 16 and rear panel 18, bottom wall 24 is rotated about fold line 30 to extend rearwardly from front panel 16 toward rear panel 18. In particular, an externally facing surface 108 of bottom wall 24 defines a bottom surface of display package 14. Flap 32 is rotated about fold line 34 relative to bottom wall 24 and is tucked behind rear panel 18 to contact an interior-facing surface 122 or exterior-facing surface 124 of rear panel 18 to form a sheath 109. To secure article 12 within display package 14, flap 32 is pulled upwardly along surface 122 or surface 124 of rear panel 18 toward top wall 106 to a position that allows article 12 to fit snugly within cavity 110 defined by sheath 109 such that a midsection of article 12 is surrounded by sheath 109. In an embodiment, flap 32 is attached to rear panel 18 and tab panels 22 and 23 are attached to each other via adhesive 33, such as glue, tape, or another fastening mechanism such as staples. In an example, adhesive 33 is applied to flap 32 and contacted with rear panel 18 to maintain sheath 109 in a particular configuration.

First stand portion 26, which extends from rear panel 18, is folded along fold line 60 so that it extends substantially parallel to and directly over exterior facing surface 124 of rear panel 18. First stand portion 26 is further folded along fold line 70 to define first extension panel 62 and first fin panel 64. In an embodiment, first extension panel 62 remains substantially parallel to or along exterior facing surface 124 of rear panel 18, while first fin panel 64 extends angled, for example, substantially perpendicularly, relative to first extension panel 62. Likewise, second stand portion 28, which extends from an opposite side of rear panel 18 from first stand portion 27, is folded along fold line 80 so that second stand portion 28 extends substantially parallel to or along exterior facing surface 124 of rear panel 18 toward first stand portion 26. In an embodiment, second stand portion 28 is further folded along fold line 90 to define second extension panel 82 and second fin panel 84. Second extension panel 82 remains substantially parallel with or along exterior facing surface 124 of rear panel 18, while second fin panel 84 extends at an angle, for example, substantially perpendicularly, relative to second extension panel 82. Fold lines 70 and 90 are aligned, and fin panels 64 and 84 are placed directly adjacent and coupled to each other. For example, fin panels 64 and 84 are coupled via an adhesive, such as glue, tape, or another fastening mechanism such as staples. In an embodiment, adhesives 91 and 93 are applied to fin panel 64 and/or 84 to adhere fin panels 64 and 84 to each other.

Fin panels 64 and 84 collectively form a two-ply fin 118 capable of being folded flat over rear panel 18 or folded out to extend away from, for example, at a substantially perpendicularly or at a non-perpendicular angle relative to, rear panel 18. Fin 118 cooperates with extension panels 62 and 84 to form a stand 120 for supporting display package 10. It will be appreciated by those with skill in the art that the above-described method for forming display package 14 is only one example of many for forming display package 14 from blank 15.

Figure 10:
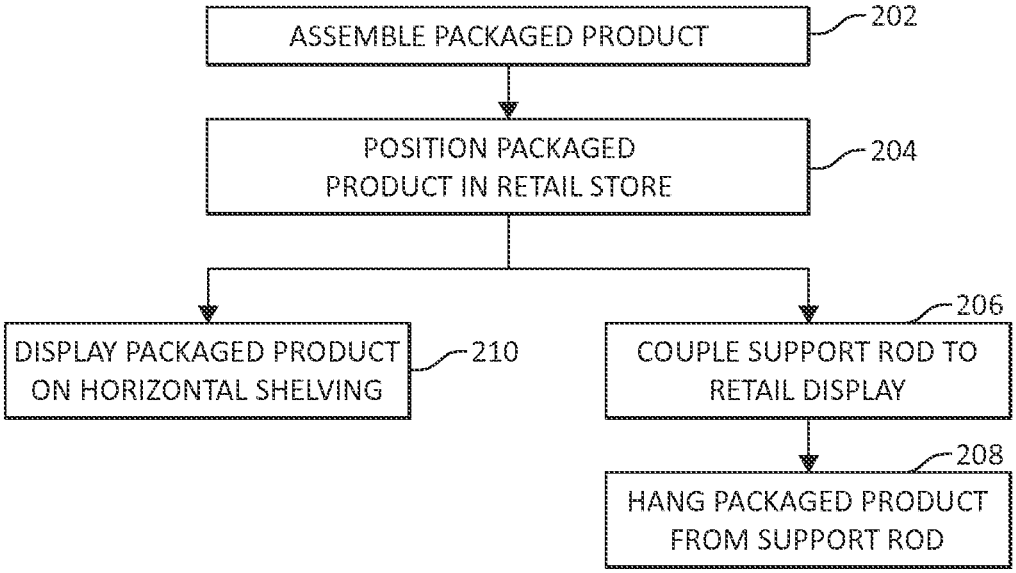
FIG. 10 is a flow chart illustrating a method of forming and displaying a packaged product, according to an embodiment of the present invention.

FIG. 10 illustrates a method 200 of assembling and displaying one or more packaged products 10 described with respect to FIGS. 1-9 and 11. In an example, display package 14 is assembled, operation 202. In particular, display package 14 is wrapped around article 12 or display package 14 is assembled and article 12 is inserted into display package 14, for example, as described in detail above.

Figure 8:
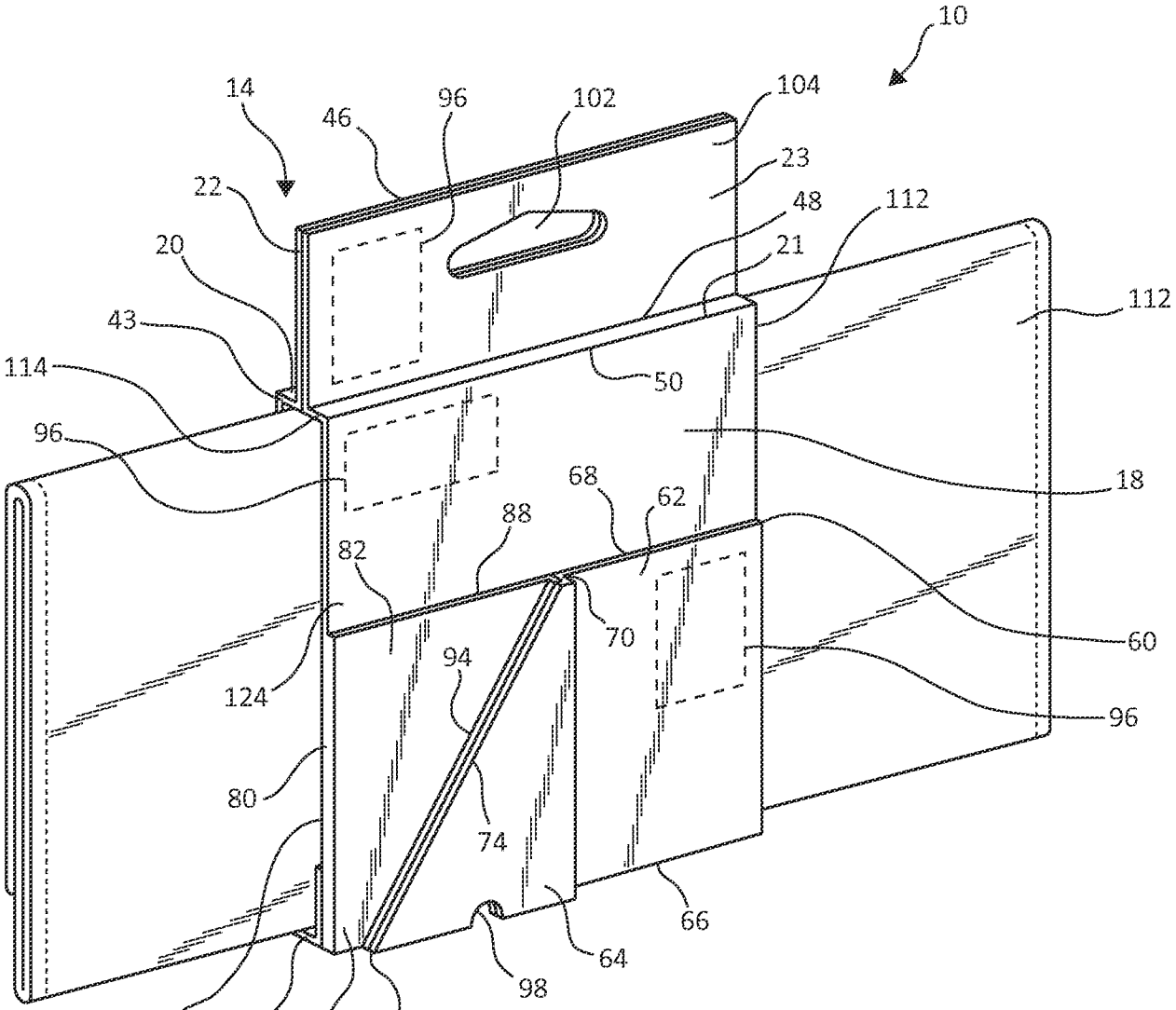
FIG. 8 is a back, perspective view illustration of the packaged product of FIG. 1 with the stand folded against the display package, according to one embodiment of the present invention.

Next, one or more fully assembled packaged products 10 are positioned in a retail store as part of a retail product display 300 (FIG. 11), operation 204. In particular, at 206, a support fixture or rod 302 is coupled to retail display 300, for example, to a vertical wall 304 of retail display 300. For example, vertical wall 304 may include a peg board surface configured to receive hooks (not shown) of support rod 302, as will be apparent to those of skill in the art upon reading this application. Support rod 302 extends from vertical wall 304 in a substantially horizontal manner. Each of the one or more packaged products 10 is hung from support rod 302 via tab 104 and opening 102 formed therethrough, operation 208. To maximize space usage, fin 118 is folded flat over rear panel 18 to thereby rest over rear panel 18, as illustrated in FIG. 8 such that fin 118 requires little or no space on support rod 302. As a result, a number of packaged products 10 can be hung in a relatively small area of retail display 300 without requiring any horizontal shelving for support.

Figure 11:
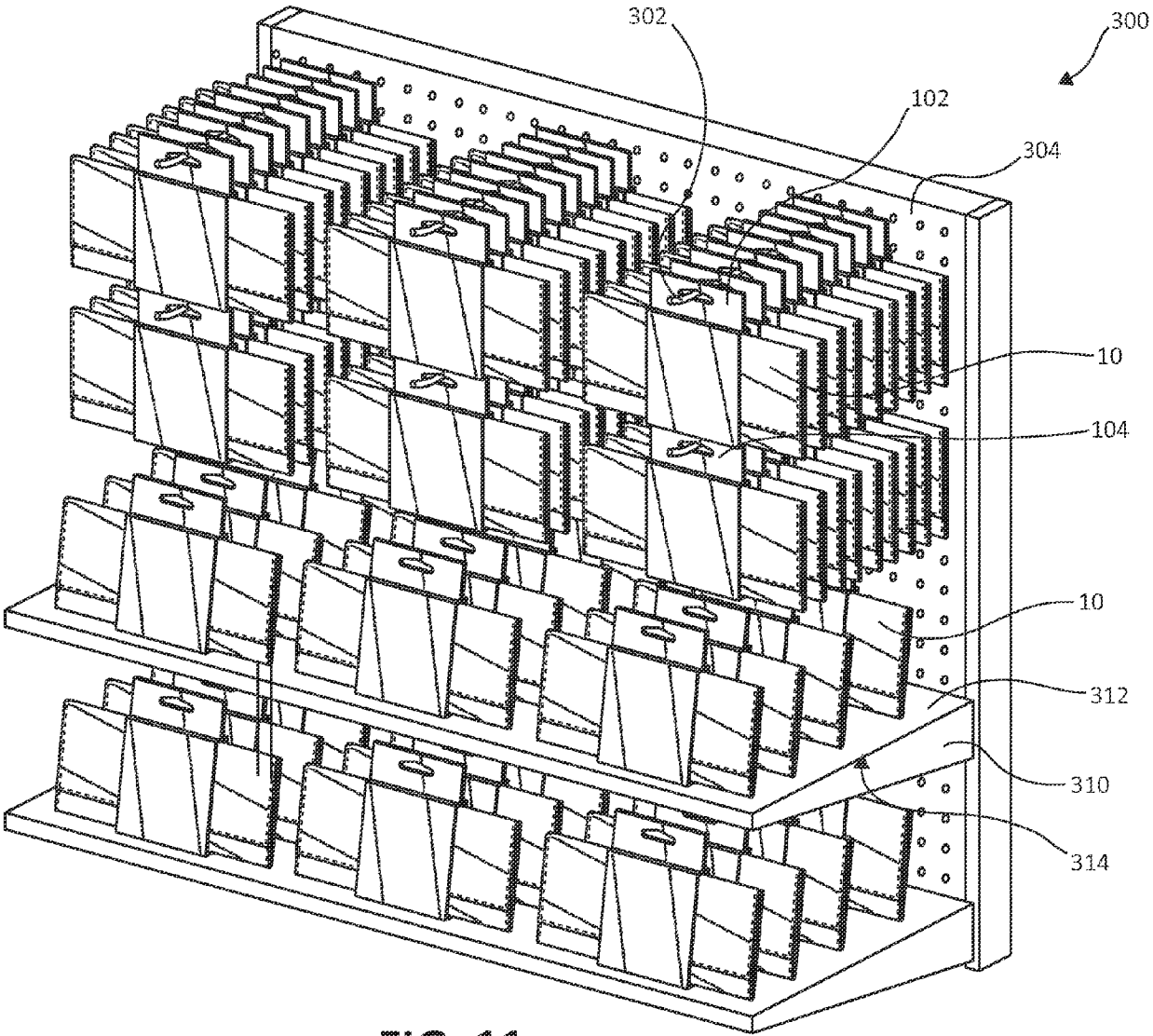
FIG. 11 is a front, perspective view illustration of a retail display including a plurality of packaged products with each of the plurality of packaged products being hung from a display fixture or stood upright on horizontal shelving, according to an embodiment of the present invention.

Alternatively, or additionally, one or more packaged products 10 are displayed on horizontal shelving 310, operation 210. More specifically, fin 118 is folded out so that stand portions 26 and 28, in particular fin walls 64 and 84, and free edge 66 of rear panel 18 form a stand 120 that extends rearwardly from display package 14 (see, e.g., FIG. 2). Stand 120 interacts with horizontal display surface 312 on horizontal shelving 310. Packaged products 10 can be arranged adjacent to other similar display packages positioned in the upright manner. For example, the display packages 14 are arranged in rows 314 along horizontal surface 312. While all articles 12 in FIG. 11 are identical or similar, it should be understood that retail product display 300 may incorporate many different styles, types, etc. of articles 12.

Packaged product 10 as described herein provides versatile and flexible packaging that can be displayed in a variety of different retail display settings. For example, for retail displays having support rods connected thereto, packaged product 10 can be hung from a support rod. In such case, because fin 118 of display package 14 can be folded flat over rear panel 18, multiple packaged products 10 can be stacked adjacent each other to maximize space usage on retail display 300 in the front to back direction. Alternatively, for retail displays that may additionally or alternatively include horizontal shelving 310, fin 118 folds outwardly from rear panel 18 to form stand 120 to allow packaged product 10 to be displayed in an upright position on a substantially horizontal support surface. Additionally, a retailer can arrange one or more packaged products 10 in an aesthetically pleasing and eye-catching manner depending upon the display space available to them. Moreover, forming display package 14 from a single continuous blank maintains costs relatively low and assembly relatively simple.

Although the invention has been described with respect to particular embodiments, such embodiments are meant for illustrative purposes only and should not be considered to limit the invention. Various alternatives and changes will be apparent to those of ordinary skill in the art. Other modifications within the scope of the invention and its various embodiments will be apparent to those of ordinary skill.

What is claimed is:

1. A display package comprising:

a wrap portion defining a front panel, a rear panel opposite the front panel, and a bottom panel extending between the front panel and the rear panel, wherein the front panel, the rear panel, and the bottom panel form a cavity therebetween for receiving an article to be displayed; and a first stand portion and a second stand portion each extending from the rear panel opposite one another;

wherein:

the first stand portion and the second stand portion each include a first wall and a second wall, each of the first walls extends from a different one of opposite outer edges of the rear panel, each of the second walls extends from a corresponding first wall opposite the rear panel, the second wall of the first stand portion and the second wall of the second stand portion are placed directly adjacent and are coupled to one another to collectively form a two-ply fin capable of being selectively folded flat over the rear panel and being selectively folded out to extend away from the rear panel to act as a stand for supporting the display package in a substantially upright position on a support surface, the first wall of the first stand portion and the first wall of the second stand portion each extend substantially parallel to and directly over the rear panel toward the other of the second stand portion and the first stand portion when the two-ply fin is folded flat over the rear panel and when the two-ply fin is folded out to act as the stand, and a face of the second wall of the first stand portion and a face of the second wall of the second stand portion are coupled to one another to collectively form the two-ply fin.

2. The display package of claim 1, wherein the display package additionally comprises means for hanging the wrap portion, and the means for hanging the wrap portion is spaced from the first stand portion and the second stand portion.

3. The display package of claim 1, wherein:

the second wall of the first stand portion and the second wall of the second stand portion have substantially identical shapes, and each of the second wall of the first stand portion and the second wall of the second stand portion defines a bottom edge that is configured to align with and to extend along the support surface when the two-ply fin is folded outwardly away from the rear panel and when the display package is disposed on the support surface.

4. The display package of claim 1, wherein the second wall of the first stand portion is adhered to the second wall of the second stand portion.

5. The display package of claim 1, wherein:

the first wall of the first stand portion borders the corresponding different one of the opposite outer edges of the rear panel along a first fold line, the first wall of the second stand portion borders the corresponding different one of the opposite outer edges of the rear panel along a second fold line, the first wall of the first stand portion borders the second wall of the first stand portion along a third fold line, the first wall of the second stand portion borders the second wall of the second stand portion along a fourth fold line, and the first fold line, the second fold line, the third fold line, and the fourth fold line extend substantially parallel to one another.

6. The display package of claim 5, wherein the first wall of the first stand portion and the first wall of the second stand portion each have widths that are about half of a width of the rear panel.

7. The display package of claim 5, wherein the first wall of the first stand portion and the first wall of the second stand portion are each shorter than the rear panel.

8. The display package of claim 5, wherein the second wall of the first stand portion and the second wall of the second stand portion are substantially triangularly shaped and are mirror images of each other.

9. The display package of claim 1, wherein the first wall of the first stand portion and the first wall of the second stand portion collectively cover an entire width of the rear panel.

10. The display package of claim 1, wherein the two-ply fin extends rearwardly from and substantially perpendicularly to the rear panel during use of the two-ply fin to support the wrap, and a two-ply fin defines a bottom edge that is substantially coplanar with the bottom panel.

11. The display package of claim 1, wherein the opposite outer edges of the rear panel extend substantially perpendicularly to the bottom panel.

12. The display package of claim 1, wherein the display package is formed as a single piece of sheet material folded to define the wrap portion, the first stand portion, and the second stand portion, with a single fold line of the single piece of sheet material separating the first wall from the second wall for each of the first stand portion and the second stand portion.

13. The display package of claim 1, further comprising a tab extending upwardly relative to the front panel and the rear panel, wherein the tab includes an opening configured to receive a support rod when the display package is hung from the support rod.

14. The display package of claim 1, wherein the front panel, the rear panel, and the bottom panel collectively define two substantially parallel longitudinal free edges that each define a corresponding substantially unobstructed side opening for receiving the article to be displayed.

15. A display package comprising:

a wrap portion defining a front panel, a rear panel opposite the front panel, and a bottom panel extending between the front panel and the rear panel, wherein the front panel, the rear panel, and the bottom panel form a cavity therebetween for receiving an article to be displayed;

a first stand portion and a second stand portion each extending from the rear panel opposite one another; and a tab extending upwardly relative to the front panel and the rear panel, wherein:

the wrap portion further comprises a first top panel extending between the tab and the front panel and a second top panel extending between the tab and the rear panel, and the tab borders the first top panel along a first fold line and the second top panel along a second fold line:

wherein:

at least a portion of the first stand portion and a portion of the second stand portion are placed directly adjacent and are coupled to one another to collectively form a two-ply fin capable of being selectively folded flat over the rear panel and being selectively folded out to extend away from the rear panel to act as a stand for supporting the display package in a substantially upright position on a support surface.

16. A packaged product comprising:

a sheath configured to hang from a support rod and to be displayed on a horizontal surface;

a product inserted into the sheath such that a midsection of the product is surrounded by the sheath and opposing ends of the product are exposed; and a stand extending from the sheath and including a support section configured to be folded away from the sheath out to an extended position and to be folded into a flattened position against the sheath, wherein:

when the support section is in the extended position, the support section of the stand is configured to interact with a horizontal surface to thereby maintain the product in a substantially upright position, when the support section is in the flattened position, the support section of the stand rests over the sheath to optimize space usage when the sheath is hung from a support rod, the stand includes an extension section and the support section, the extension section includes a first extension wall and a second extension wall, the first extension wall and the second extension wall each extend from an opposite side edge of the sheath toward the other of the first extension wall and the second extension wall in a manner substantially parallel to a back surface of the sheath to collectively cover an entire width of the sheath as measured between the opposite side edges of the sheath, and the support section of the stand is configured to be folded away from the sheath out to the extended position and folded against the sheath into the flattened position.

17. The packaged product of claim 16, wherein:

the sheath is defined by a first major wall, a second major wall opposite the first major wall, and a base wall extending from the first major wall to the second major wall, the first major wall, the second major wall, and the base wall collectively form a first side opening and a second side opening opposite the first side opening, and each of the first side opening and the second side opening are substantially unobstructed and is at least partially defined by one of the opposite side edges of the sheath.

18. The packaged product of claim 16, wherein:

the support section includes a first support wall extending from the first extension wall and a second support wall extending from the second extension wall, and the first support wall extending from the first extension wall is attached to the second support wall extending from the second extension wall to form the support section as a two-ply support section.

19. The packaged product of claim 17, further comprising a tab extending from the first major wall and the second major wall and including an aperture configured to receive the support rod.

20. The packaged product of claim 19, wherein:

the first major wall borders the tab along a first fold line, the tab borders the second major wall along a second fold line, the second major wall borders the base wall along a third fold line, the first extension wall borders one of the opposite edges of the sheath as defined by the second major wall along a fourth fold line, the second extension wall borders the other one of the opposite side edges of the sheath as defined by the second major wall along a fifth fold line, a first support wall of the support section borders the first extension wall along a sixth fold line, a second support wall of the support section borders the second extension wall along a seventh fold line, and the first support wall and the second support wall form the portion of the stand configured to be folded out to the extended position and fold into the flattened position.

21. The packaged product of claim 17, wherein:

the sheath includes a flap bordering the base wall along a fold line, and the flap is adhered to an interior surface of the second major wall.

22. The packaged product of claim 18, wherein the first support wall and the second support wall comprise mirror image triangles adhered together along their faces to define a two-ply component, each of the mirror image triangles has a base edge configured to contact the horizontal surface and a lateral side edge extending from a corresponding one of the first extension wall or the second extension wall and terminating at a corresponding base edge.

23. The packaged product of claim 20, wherein the fourth fold line, the fifth fold line, the sixth fold line, and the seventh fold line each extend substantially parallel with each other.

* * * * *